US008322440B2

(12) United States Patent
Christie

(10) Patent No.: US 8,322,440 B2
(45) Date of Patent: Dec. 4, 2012

(54) INTEGRATED ELECTRICAL CONNECTOR FOR USE IN A WELLHEAD TREE

(75) Inventor: Davis S. Christie, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 744 days.

(21) Appl. No.: 12/399,549

(22) Filed: Mar. 6, 2009

(65) Prior Publication Data

US 2009/0223674 A1 Sep. 10, 2009

Related U.S. Application Data

(60) Provisional application No. 61/034,402, filed on Mar. 6, 2008.

(51) Int. Cl.
*E21B 43/01* (2006.01)

(52) U.S. Cl. ..... 166/368; 166/351; 166/373; 166/65.1; 166/66.6; 340/854.9

(58) Field of Classification Search ..... 166/368, 166/339, 341, 344, 348, 351, 352, 250.01, 166/373, 381, 386, 65.1, 66, 66.6; 439/191–195; 340/854.9, 855.1, 855.2
See application file for complete search history.

(56) References Cited

U.S. PATENT DOCUMENTS

| | | | | |
|---|---|---|---|---|
| 4,491,176 | A * | 1/1985 | Reed | 166/66.4 |
| 4,561,499 | A | 12/1985 | Berner, Jr. et al. | |
| 4,958,686 | A | 9/1990 | Putch | |
| 5,052,941 | A * | 10/1991 | Hernandez-Marti et al. | 439/194 |
| 5,209,673 | A * | 5/1993 | Mohn et al. | 439/199 |
| 5,366,017 | A * | 11/1994 | Voss, Jr. | 166/368 |
| 5,465,794 | A * | 11/1995 | McConaughy et al. | 166/375 |
| 5,555,935 | A * | 9/1996 | Brammer et al. | 166/88.1 |
| 5,865,250 | A * | 2/1999 | Gariepy | 166/375 |
| 6,062,314 | A * | 5/2000 | Nobileau | 166/368 |
| 6,244,348 | B1 * | 6/2001 | Gariepy et al. | 166/375 |
| 6,302,212 | B1 * | 10/2001 | Nobileau | 166/368 |
| 6,394,837 | B1 * | 5/2002 | Edwards et al. | 439/426 |
| 6,516,876 | B1 * | 2/2003 | Jennings | 166/77.51 |
| 6,520,253 | B2 * | 2/2003 | Calder | 166/84.4 |
| 6,598,680 | B2 * | 7/2003 | DeBerry | 166/368 |
| 6,681,861 | B2 * | 1/2004 | Davidson et al. | 166/382 |
| 6,715,555 | B2 * | 4/2004 | Milberger et al. | 166/368 |

(Continued)

FOREIGN PATENT DOCUMENTS

GB 2397312 A 7/2004

(Continued)

OTHER PUBLICATIONS

Combine Search and Examination Report, Application No. GB0903886.0, dated Jul. 29, 2009.

*Primary Examiner* — Matthew Buck
(74) *Attorney, Agent, or Firm* — Bracewell & Giuliani LLP

(57) ABSTRACT

A wellhead assembly having a data sensor circuit for transmitting sensed data from within a wellbore to the well surface. The circuit includes a signal conduit axially inserted within the wall of a stab unit with connectors at the top and bottom portions of the stab unit. Corresponding connection leads are included within the wellhead assembly to connect with the stab unit connectors. The connectors may comprise a gallery ring wet connect.

15 Claims, 5 Drawing Sheets

U.S. PATENT DOCUMENTS

| | | | | |
|---|---|---|---|---|
| 6,736,208 | B2 * | 5/2004 | Riddell et al. | 166/88.4 |
| 6,763,891 | B2 * | 7/2004 | Humphrey et al. | 166/368 |
| 6,776,230 | B2 * | 8/2004 | Collie et al. | 166/97.1 |
| 6,942,028 | B2 * | 9/2005 | Hosie | 166/88.4 |
| 6,974,341 | B2 * | 12/2005 | Jennings | 439/191 |
| 7,013,970 | B2 * | 3/2006 | Collie et al. | 166/89.1 |
| 7,114,970 | B2 * | 10/2006 | Head | 439/191 |
| 7,201,229 | B2 | 4/2007 | White et al. | |
| 7,806,191 | B2 * | 10/2010 | Braden et al. | 166/380 |
| 7,845,415 | B2 * | 12/2010 | Allen | 166/375 |
| 2008/0230229 | A1 | 9/2008 | Shaw et al. | |

FOREIGN PATENT DOCUMENTS

| | | | |
|---|---|---|---|
| GB | 2403490 | A | 5/2005 |
| GB | 2437286 | A | 10/2007 |
| WO | 01/81710 | A1 | 11/2001 |

* cited by examiner

INTEGRATED ELECTRICAL CONNECTOR FOR USE IN A WELLHEAD TREE

CROSS REFERENCE TO RELATED APPLICATIONS

This application claims priority to and the benefit of co-pending U.S. Provisional Application Ser. No. 61/034,402, filed Mar. 6, 2008, the full disclosure of which is hereby incorporated by reference herein.

BACKGROUND

1. Field of Invention

The device described herein relates generally to wellhead assemblies, and in particular to provide a connector for a data and/or power signal line integral with wellhead assembly components.

2. Description of Related Art

Wellheads used in the production of hydrocarbons extracted from subterranean formations typically comprise a wellhead assembly. Wellhead assemblies are attached at the upper ends of wellbores that intersect hydrocarbon producing formations. Wellhead assemblies also provide support for tubing and casing inserted into the wellbore. The casing lines the wellbore, thereby isolating the wellbore from the surrounding formation. The tubing typically lies concentric within the casing and provides a conduit for producing the hydrocarbons entrained within the formation. Wellhead assemblies also typically include trees that connect to the upper end of the tubing and distribute the produced fluids, provide an injection means into the well, or another well related operation.

Sensors measuring pressure, temperature, or other downhole conditions, as well as electrical pumps may be disposed within production tubing that is used in producing wellbore fluids. Electrical signals representing sensor recordings are typically transmitted via a hardwire circuit, that typically includes wires or other conducting elements, connecting the sensors to a surface element. The surface element may comprise a control panel, an information handling system, a digital recording device, an analog recording device, and any other device or system for recording and/or analyzing sensor data.

Making up the wellhead assembly typically involves stabbing the tree onto a wellhead housing. Mating male/female electrical connectors are provided respectively in the tree and the wellhead housing to complete the hardwired circuit between the sensors and the surface. The connectors have traditionally been rigid members having a male and a female fitting that connect when the tree is stabbed on to the wellhead housing. These rigid connectors occupy a certain amount of space within the wellhead housing that reduces the amount of tubing cross sectional area. Additionally, the connectors may be offset from the production tubing housing, or in the case of a horizontal tree the connectors may extend laterally from the tree to the tubing hanger; thus the tree must be oriented in a proper radial position to ensure mating of corresponding male and female connections of the electrical connection.

SUMMARY OF INVENTION

The present device comprises a signal connector integral with standard wellhead assembly components. The connector comprises a conducting element, such as a wire, disposed within an annular member connected to a wellhead tree. One example of an annular member on a conventional tree is a stab unit. The lower terminal end of the stab unit is coaxial with wellbore production tubing within a wellhead assembly. Another example is a tubing hanger. The connection also comprises electrical contacts between a point in the annular stab/tubing hanger and the tree and wellhead hardware housed within a wellhead housing. In one embodiment, the lower connector is housed within a tubing hanger. Optionally, the electrical contacts at the upper and lower end of the annular stab are wet connects. The electrical connector may comprise an annular member that mates with a corresponding conducting element. Thus, the need for a dedicated connector is not required, which allows for additional annular space to be used by production tubing.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
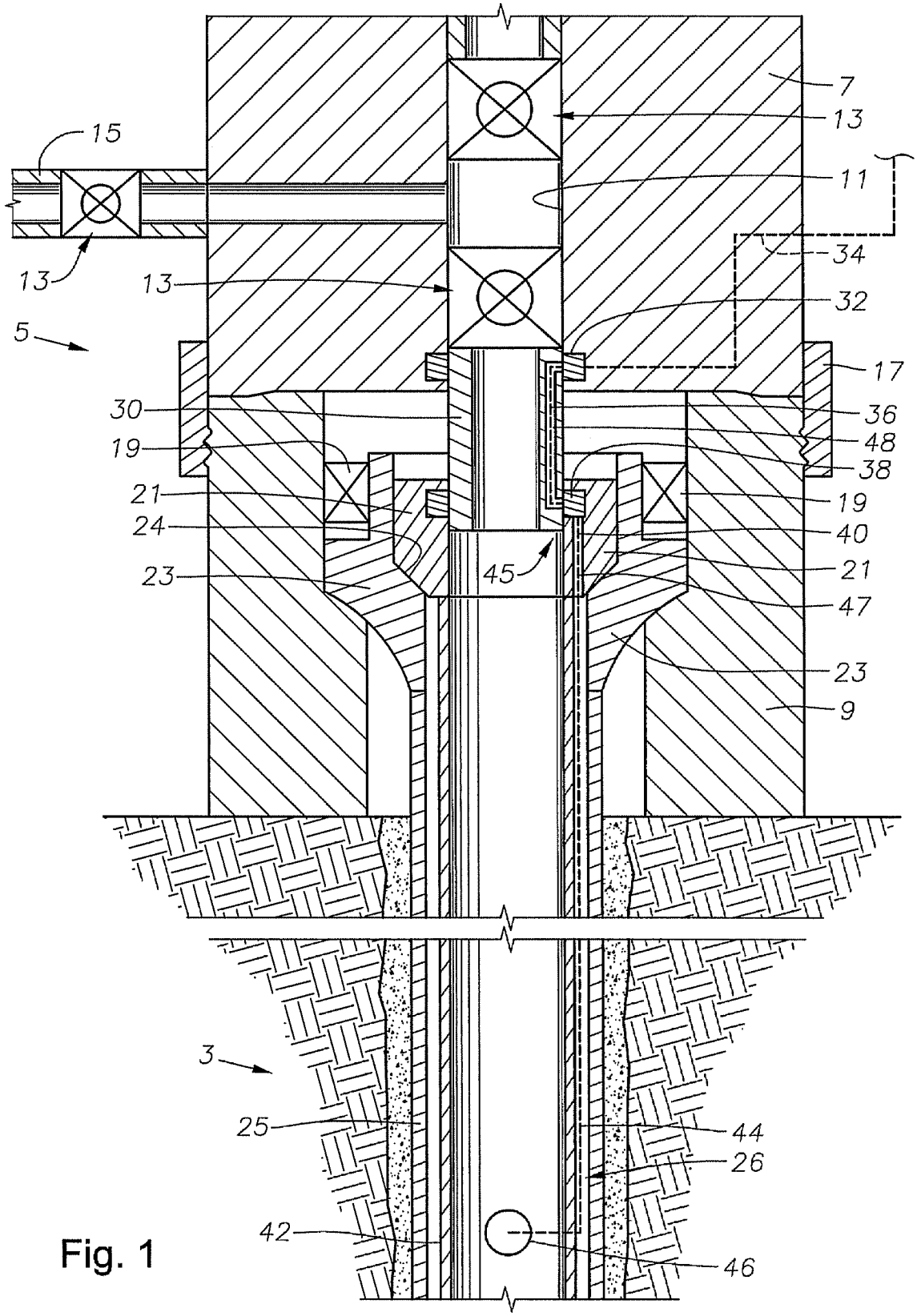
FIG. 1 is a side cross sectional view of an embodiment of a wellhead assembly having an integral electrical connector.

FIG. 1 illustrates an embodiment of an integral wellhead assembly connector. A wellhead assembly 5 is shown in cross sectional view comprising a tree 7 mounted atop a wellhead housing 9. Formed within the tree 7 is a production bore 11 that provides fluid communication between the wellbore 3 and production flow line 15 of wellhead assembly 5. In the embodiment shown, a portion of the production bore 11 extends laterally within the tree 7 to production flowline 15. Isolation valves 13 are provided in the production bore 11 and also on the production flowline 15. Selectively opening and closing the isolation valves 13 can allow wellbore fluid flow into the lateral production tubing 15 or provide access from above to the production bore 11.

The tree 7 is attached to the wellhead housing 9 by an external connector 17. The type of tree 7 is not limited to the embodiment illustrated, but can include any type of tree, including a production tree, an injection tree, and other members mounted on a wellhead having valves to direct flow in and/or out of a wellbore. The housing 9 includes therein production tubing 42, a tubing hanger 21, and a casing hanger 23. The casing hanger 23, which is a generally annular member, is coaxially secured within a portion of the housing 9. Pack offs 19 (also referred to as casing hanger seals) are disposed between the outer circumference of the casing hanger 23 in a portion of the inner circumference of the housing 9. An inner bowl 24 is provided within the casing hanger 23 formed to receive the tubing hanger 21. Optionally, the tubing hanger 21 can land on top of the casing hanger 23 and seal on the wellhead housing 9. Production tubing 42 extends downward into the wellbore 3 from the tubing hanger 21. An annular isolation sleeve 30 is shown extending coaxially within the tree 7 to within the tubing hanger 21. As shown, wellbore flow from the production tubing 42 may reach the production bore 11 through the isolation sleeve 30. The upper end of the isolation sleeve 30 is sealed to the production bore 11 and the lower end to tubing hanger 21 by seals (not shown).

A sensor 46 is schematically depicted in a portion of the tubing 42 that protrudes within the wellbore 3. The sensor 46 may be used for sensing pressure, temperature, or other downhole conditions. Optionally, multiple sensors may be employed with the embodiment described herein. The sensor 46 comprises a portion of a wellbore sensing system having a monitoring/recording means at the surface. An example of sensor 46 to surface communication is illustrated by a signal medium 44 shown passing through the tubing 42 sidewall, up the annulus between the tubing 42 and casing 25, and exiting the tree 7. The signal circuit 45 may include any element used for conveying a signal, examples include electrically conducting wire, fiber optic members, connectors, and pneumatic lines, to name but a few. Optionally, a medium for conducting electrical power may also be included with the wellhead assembly 5 and routed the same as or similar to the signal circuit 45. The power conducting medium, such as for example an electrically conducting wire, may be disposed in the same bore or passage as the signal circuit 45, in place of the signal circuit 45, or azimuthally from the signal circuit 45. In one optional embodiment, the signal circuit 45 and electrically conducting medium are combined in a single medium/conduit configured to transmit both signals and electrical power. In another optional embodiment, the signal transmitted in accordance with the present description includes one or more data signals. Optionally, the data signals may include a broad band signal.

The signal circuit 45 comprises segments that pass through, along, or adjacent various production hardware components. Each segment is individually referenced for clarity; for example, the segment of the conduit in the annulus 26 between tubing 42 and casing 25 is referred to as the annular annulus wire 44. A passage 47 shown through the tubing hanger 21 provides a pathway for the signal circuit 45 to the isolation sleeve 30. This segment of the signal circuit 45 is referred to as the tubing hanger wire 40. Another passage 48 shown formed through the isolation sleeve 30 wall having a sleeve wire 36 segment. Connectors 32, 38 are shown respectively provided at the upper and lower terminal ends of the isolation sleeve 30. The sleeve wire 36 upper and lower ends join the connectors 32, 38. In the embodiment shown, these connectors 32, 38 include gallery ring connectors circumscribing the isolation sleeve 30. The annular connector 32 provides communication between the sleeve wire 36 and the feed wire; the annular contact 38 provides communication between the sleeve wire 36 and the tubing hanger wire 40. The seals on the isolation sleeve 30 prevent exposing the contacts to corrosive well fluids thus extending connector life. The feed wire 34, shown in dashed outline, extends from the connector 32 to outside of the tree 7. Embodiments exist having multiple electrical connectors on the isolation sleeve 30 with associated sleeve wires 36.

Figure 2:
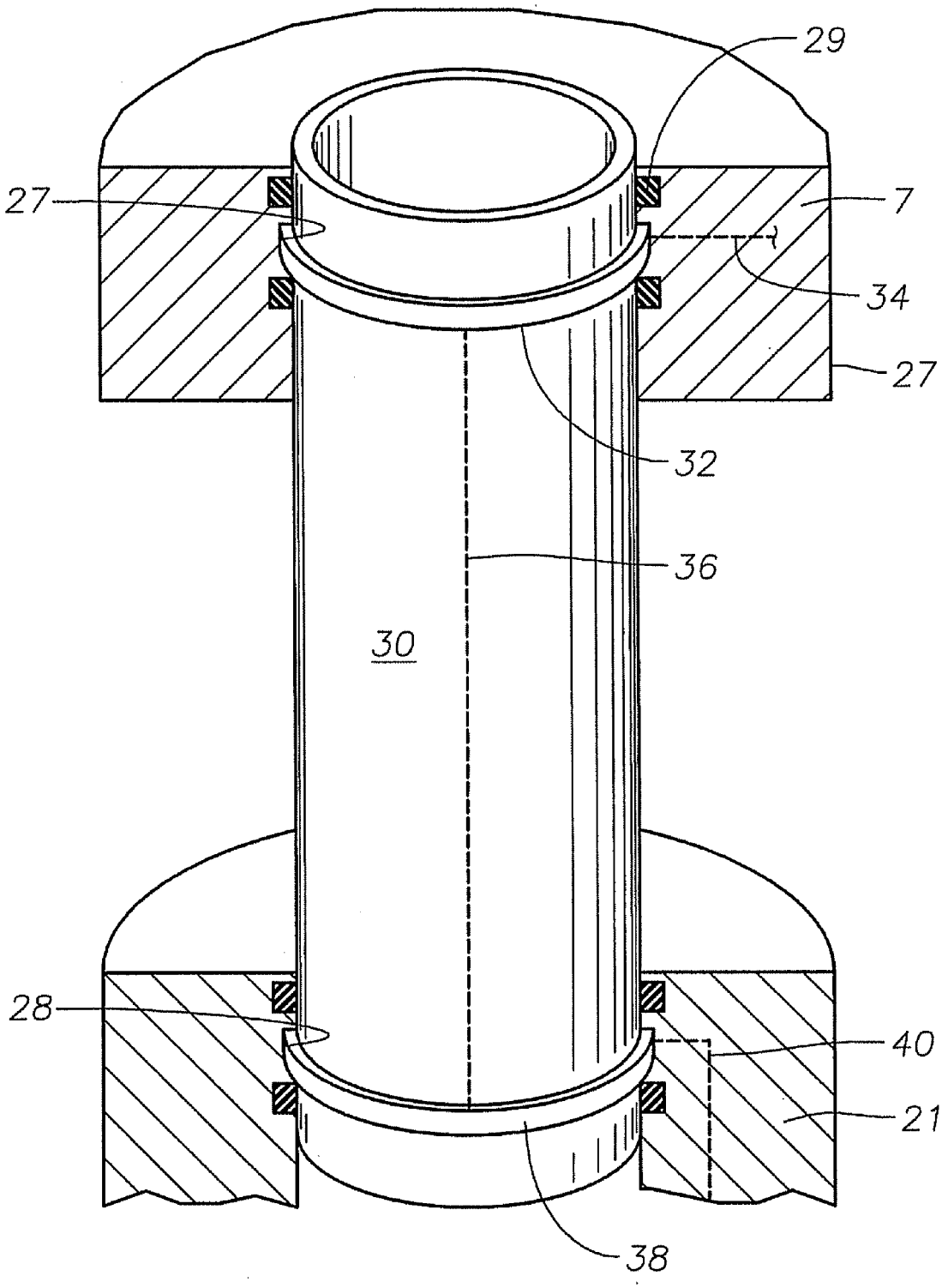
FIG. 2 is a side perspective view of an isolation sleeve having electrical contacts.

Examples of the connectors 32, 38 are shown in perspective view in FIG. 2. Here, the connectors 32, 38 are disposed respectively in annular channels 27, 28 formed both within the tubing hanger 21 and the production bore 11 inner circumferences. Optionally, channels may be formed in the outer surface of the isolation sleeve 30 for housing the gallery ring connectors 32, 38. The gallery ring connector 38 and seals 29 disposed within the tubing hanger 21 should be configured to withstand exposure to corrosive fluids, such as salt water.

Figure 3:
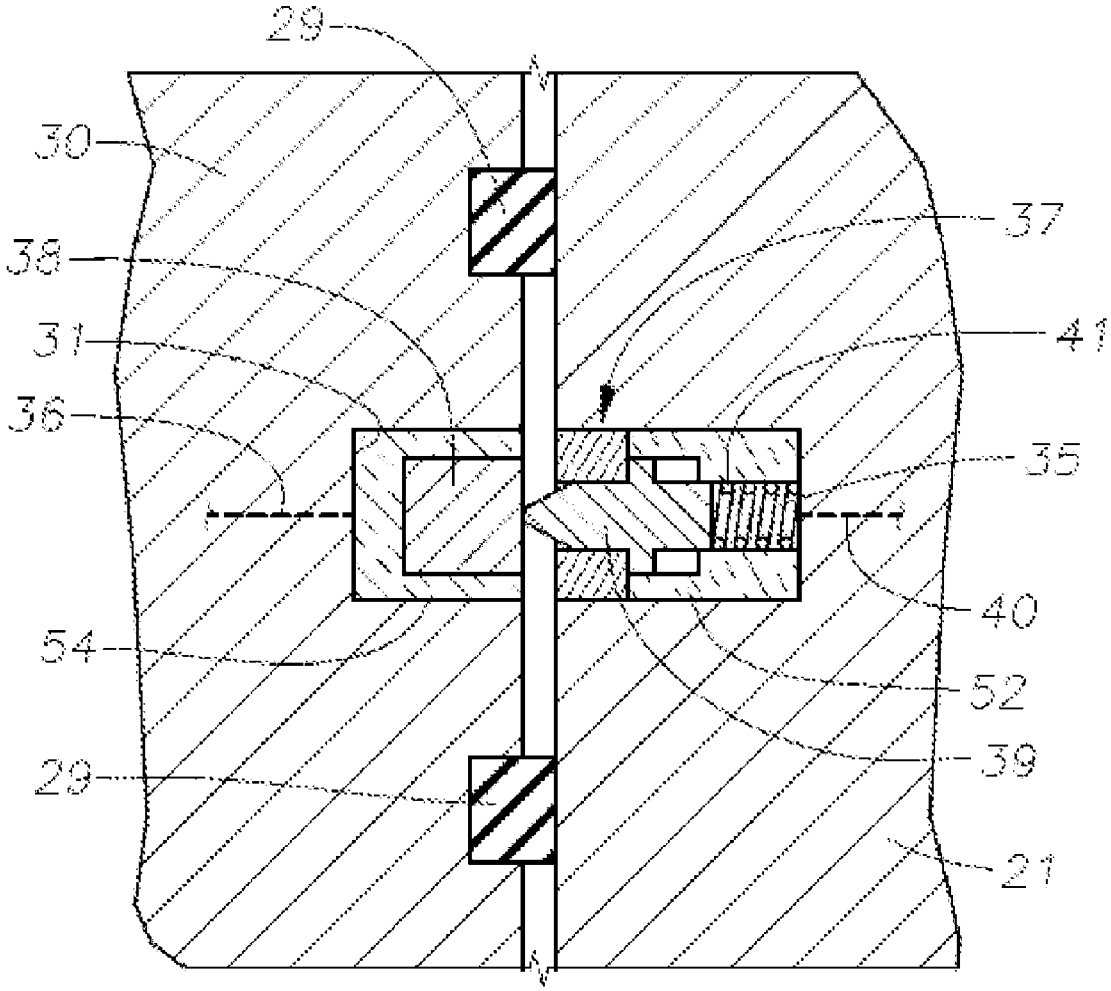
FIG. 3 is a cross sectional view of one of the electrical contacts of FIG. 2.

FIG. 3 illustrates a sectional view a connection embodiment between connector 38 and the tubing hanger wire 40. The connection between connector 32 and the feed wire 34 can be same as the connection depicted in FIG. 3. In this embodiment, the gallery ring connector 38 is in an isolation sleeve groove 31 having an insulator 54 disposed between the connector 38 and the isolation sleeve 30. The sleeve wire 36 connects to the annular ring connector 38 on its inner circumference. A cavity 35 is formed opposite to the sleeve groove 31 in the tubing hanger 21. A pin 39 with a corresponding contact spring 41 is mounted in the cavity 35. The spring 41 urges the pin 39 outward from the cavity 35 into mating contact with the ring connector 38. The pin 39 is shown in communication with the tubing feed wire 40 and the annular connector 38 is shown in communication with the sleeve wire 36. Thus forming mating contact between the pin 39 and the connector 38 communicates the tubing feed wire 40 and sleeve wire 36, wherein communication includes electrical current, signals, data and the like. Optionally, a stop assembly 37 may be employed that also restricts outward movement of the pin 39 from the spring 41. The connection example provided in FIG. 3 can be similarly utilized for connection between the sleeve wire 36 and the feed wire 34 through the annular ring 32.

The embodiment of FIG. 3 may be a wet connect by sealing the connection components and the opposing surfaces. For example, a removable sealing material may be temporarily inserted over the pin 39 during make up to keep it within the cavity 35. Seals 29 may be provided above and below the groove 31 and cavity 35 to prevent the inflow of pressure, water, or oil. The construction of the wet connect providing electrical connectivity between the isolation sleeve and the tree 7 and tubing hanger 21 is not limited to the embodiments shown. Insulators 52, 54 are shown in the groove 31 and cavity 35 which provide electrical insulation between the pin 39 and the gallery ring 38 and the surrounding formation.

Figure 4:
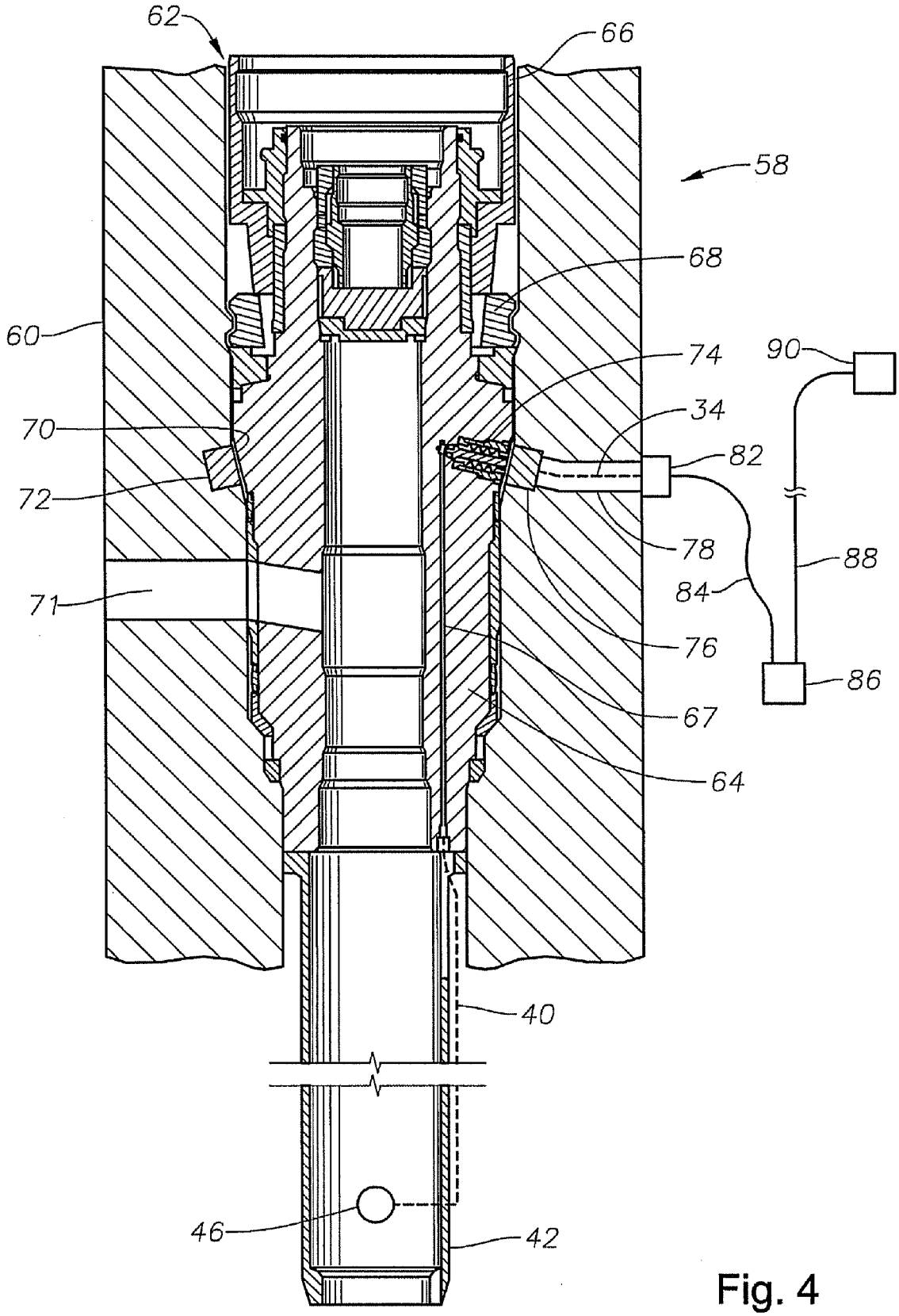
FIG. 4 is a section view of a connector a plunger connector with a bellows sleeve connectable with an annular ring.

An alternative connector embodiment for use in a wellhead assembly 58 is provided in a side sectional view in FIG. 4. As, shown, the wellhead assembly 58 includes a tree 60 with a bore 62 formed axially therethrough. A tubing hanger 64 is landed within the bore 62 and affixed to the tree 60 by profiled latching dogs 68 shown engaging corresponding profiles on the bore 62 inner circumference. In the embodiment shown, the dogs 68 are urged radially outward by axially forcing a hanger actuator 66 between the dogs 68 and the tubing hanger 64. A portion of the hanger 64 outer circumference is conically profiled to form a sealing surface 70. When landed, the sealing surface 70 contacts a conically profiled sealing surface 72 on the bore 62 outer surface. A sealed connector 74 in the tubing hanger 64 is shown in a recess in the sealing surface 70. A gallery ring 76 circumscribes the tree sealing surface 72, so that landing the tubing hanger 64 in the tree 60 registers the sealed connector 74 and gallery ring 76 and lateral passage 71 through tree 60 and tubing hanger 64. Optionally, the gallery ring 76 can be in the tubing hanger 64 and the sealed connector 74 in the tree 60. The sealed connector 74 connects with the tubing hanger wire 40 shown extending through an axial bore 67 formed in the hanger 64 between the sealed connector 74 and the tubing/casing annulus 26. The gallery ring 76 is shown connected to the feed wire 34 shown in passage 78, feed wire 34 connects on its terminal end with a junction box; in the embodiment shown the junction box is a service control module (SCM) 82. A lead 84 connects the SCM 82 with an umbilical termination 86, which is communication with a remote location 90 via an umbilical 88. The remote location 90 can be a unit above the sea surface, such as workover rig, or can be a production facility.

Figure 5:
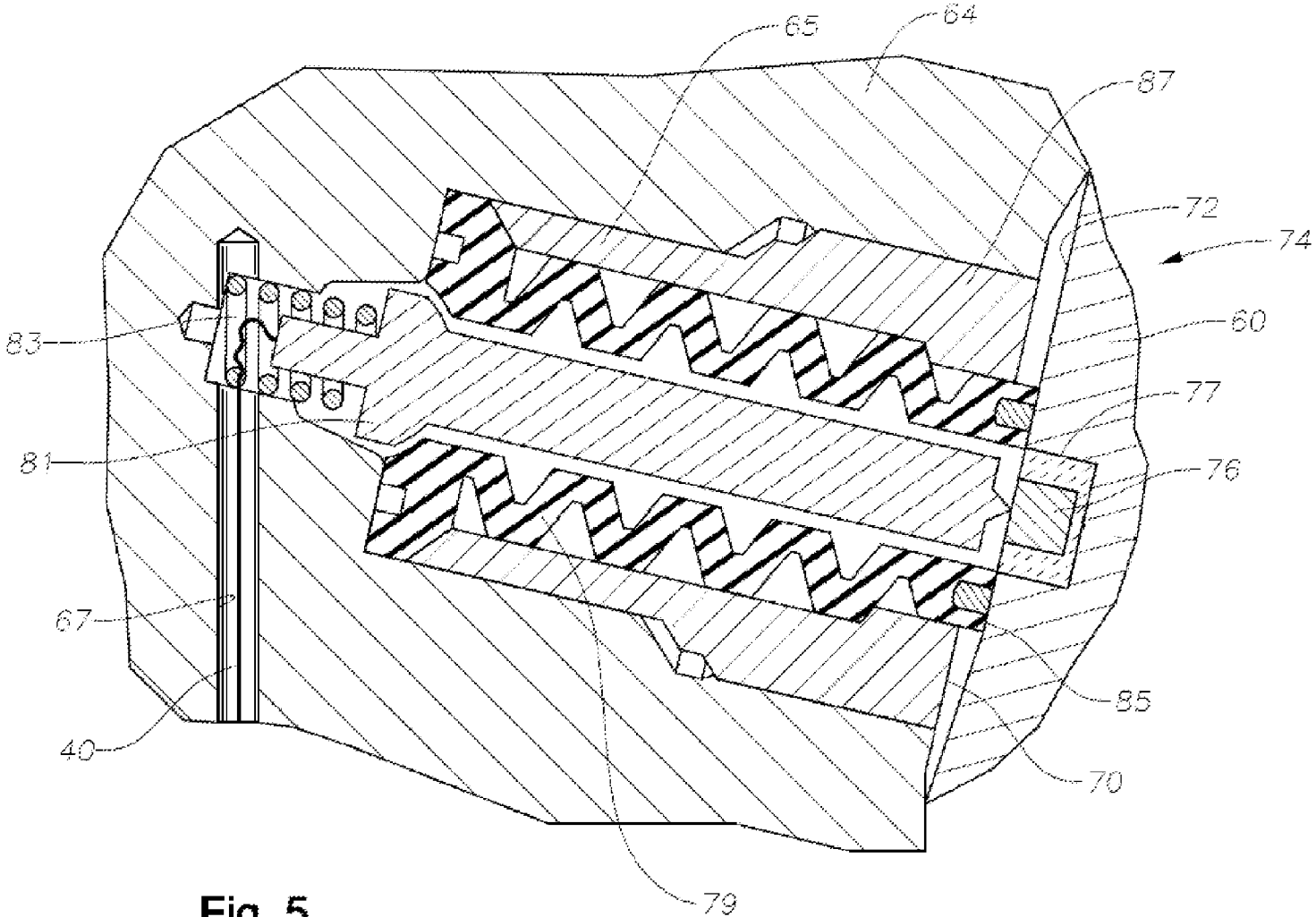
FIG. 5 is a sectional view of the connector of FIG. 4.

Referring now to FIG. 5, an example of a sealed connector 74 is illustrated in a partial sectional view. The connector 74 includes an annular body 87 shown inserted into a recess 65 in the tubing hanger 64. Disposed within the body 87 is a sleeve 79 with a bellows like cross section. The sleeve's 79 bellows like structure allow the sleeve 79 to expand and contact lengthwise. Seals 85 are included with the sleeve 79 front face where it contacts the tree sealing surface 72. Coaxial within the sleeve 79 is a plunger 81 shown pushed into contact with the gallery ring 76 by a spring 83. The gallery ring 76 is shown set in a groove 77. The tubing annulus wire 40 is shown connecting to the rearward end of the plunger 81 adjacent the spring 83. Thus, similar to the assembly depicted in FIG. 3, a signal circuit is completed by landing the tubing hanger 64 of FIGS. 4 and 5 into the tree 60 so that the sealed connector 74 contacts the gallery ring 76.

In one example of use, the sensor 46 emits a signal that is conducted through the remaining portions of the signal circuit 45. The signal can be digital or analog, and can represent a condition or property detected by the sensor 46. The signal can be stored in memory subsea, or transmitted realtime from subsea to above the sea surface. The signal can be used for well monitoring or well control, thus above surface signal remote destinations can include a production control facility, a workover rig, as well as a workboat. The sensor circuit 45 can further include a return path for control signals provided from one or more of the remote destinations.

Accordingly, implementation of the present device allows for signals to be safely transmitted from within the wellbore to the surface via the normal production/annulus stingers, for example between the tree and the tubing hanger. This eliminates the potential for damage that can occur with currently known electrical connectors.

It is to be understood that the invention is not limited to the exact details of construction, operation, exact materials, or embodiments shown and described, as modifications and equivalents will be apparent to one skilled in the art. For example, the connector ring may comprise a pair of concentric rings with the inner ring integral with the stab member and the outer ring integral with the wellhead assembly. Additionally, multiple isolated electrical connectors may be included with embodiments of the device disclosed herein. Optionally each connection is insulated from the other. In another alternative, the electrical return or ground can either be via one of the above described connections or to earth. In the case of a horizontal tree the embodiment may be incorporated onto existing hydraulic control line couplers or on an alternative lateral entry production stab. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

What is claimed is:

1. A subsea wellhead assembly provided on a borehole, the assembly comprising:

a tree on a wellhead housing;

tubing extending into the borehole;

casing circumscribing the tubing to form an annulus therebetween;

an annular member having a portion circumscribed by the tree;

a bore axially formed through a wall of the annular member;

an electrically conductive member disposed in the annular member bore and in electrical communication with a device disposed in the borehole;

a connection having an end in electrical communication with the electrically conductive member, the connection comprising an annular ring connectable with a ring contact;

a tubing hanger coaxially circumscribing the lower end of the annular member;

a bore axially formed through a wall of the tubing hanger;

an electrically conductive member in the bore in the wall of the tubing hanger;

a second connector having one end connected to the electrically conductive member in the bore of the tubing hanger and an opposite end connected to the electrically conductive member in the annular member bore; and a feed member in electrical communication with the end of the connection opposite the electrically conductive member, so that the feed member is in communication with the borehole device when the annular ring and ring contact are connected.

2. The subsea wellhead assembly of claim 1, further comprising an upper groove formed in the tree and circumscribing the annular member, the upper groove having the annular ring therein and the ring contact being provided in the annular member.

3. The subsea wellhead assembly of claim 1, further comprising an upper groove formed in the annular member circumscribed by the tree, the upper groove having the annular ring therein and the ring contact being provided in the tree.

4. The subsea wellhead assembly of claim 1, wherein the ring contact comprises a plunger urged into contact with the annular ring by a resilient member.

5. The subsea wellhead assembly of claim 4, further comprising a bellows like sleeve circumscribing the plunger.

6. The subsea wellhead assembly of claim 1, further comprising a module connected to the feed member that is in communication with a remote location, so that the borehole device is in communication with the remote location.

7. The subsea wellhead assembly of claim 1, further comprising a recess in the tubing hanger outer surface, an extendable plunger in the recess that is in electrical communication with the borehole device, a groove in the tree circumscribing the tubing hanger, and the annular ring in the groove, so that extending the plunger from the recess contacts the annular ring and electrically communicates the feed member with the borehole device.

8. The subsea wellhead assembly of claim 1, wherein the borehole device is selected from the list consisting of a downhole sensor, a downhole valve, and a downhole choke.

9. A subsea wellhead assembly comprising:

a production bore axially formed through the wellhead assembly and in communication with a borehole;

a wellhead housing;

a tree provided on the wellhead housing;

an annular tubular coaxial with the bore and landed within the tree;

a tubing hanger in the tree circumscribing a portion of the annular tubular;

a bore formed axially through a wall of the annular tubular;

a passage axially extending in a wall of the tubing hanger having an electrically conductive element provided therein;

an electrically conductive element in the bore in the annular tubular in electrical communication with the electrically conductive element in the passage in the tubing hanger;

a passage in the tree having an electrically conductive feed line in communication with a control facility; and a connector assembly comprising an annular ring, a ring contact in selective electrical contact with the annular ring, a first end electrically connected to the feed line, and a second end electrically connected to the electrically conductive element, so that selectively contacting the annular ring and the ring contact defines a control circuit comprising the electrically conductive element in the passage in the tubing hanger, the electrically conductive element in the bore in the annular tubular, the connector assembly, and the electrically conductive feed line.

10. The subsea wellhead assembly of claim 9, further comprising production tubing depending from the tubing hanger into the borehole, casing depending into the borehole circumscribing the production tubing to define an annulus between the casing and the production tubing, and the electrically conductive element in the passage in the tubing hanger extending into the annulus connected on one end to a device in the borehole and on the other end to the electrically conductive element in the bore in the annular tubular.

11. The subsea wellhead assembly of claim 9, further comprising a groove in the tree circumscribing the annular tubular and a recess in the annular tubular formed to face the groove when the annular tubular is landed in the tree, wherein the annular ring is disposed in the groove and the ring contact is in the recess.

12. The subsea wellhead assembly of claim 10, wherein the device is selected from the list consisting of a sensor, a valve and a choke.

13. A wellhead assembly for producing hydrocarbons from a subsea wellbore, the assembly comprising:

a wellhead housing anchored on the sea floor over the wellbore;

a tree connected to the wellhead housing;

a first passage formed through the tree;

a first electrically conductive element in the first passage in communication with a remotely located control facility;

a production bore axially provided through the wellhead housing and tree in communication with the wellbore;

a tubular stab member in the production bore and extending from within the tree to within the wellhead housing;

a second passage provided in the stab member wall;

a second electrically conductive element in the second passage;

a tubing hanger circumscribing a lower portion of the stab member;

a third passage formed axially through the tubing hanger wall;

tubing depending from the tubing hanger into the wellbore coaxially within casing in the wellbore to define an annulus between the tubing and the casing;

a wellbore device in the tubing;

a third electrically conductive element provided in the third passage, into the annulus, and connected to the device;

a first connector comprising an annularly shaped conductor, a ring contact in selective electrically communication with the annularly shaped conductor, an upper end connected to the first electrically conductive element, and a lower end connected to the second electrically conductive element; and a second connector comprising an annularly shaped conductor, a ring contact in selective electrically communication with the annularly shaped conductor, an upper end connected to the second electrically conductive element, and a lower end connected to the third electrically conductive element.

14. The wellhead assembly of claim 13, further comprising an upper groove in the tree circumscribing the stab member and a lower groove in the tubing hanger circumscribing the stab member, wherein the annularly shaped conductor of the first connector is in the upper groove and the annularly shaped conductor of the second connector is in the lower groove.

15. The wellhead assembly of claim 13, wherein the first electrically conductive element contacts the upper connector at a first position and the second electrically conductive element contacts the upper connector at a second position, wherein the first and second positions are at different angular locations about the production bore axis.

* * * * *